United States Patent [19]

Lin

[11] Patent Number: 4,957,315

[45] Date of Patent: Sep. 18, 1990

[54] AUXILIARY LOCK WITH AN EXTENSIBLE DEVICE

[76] Inventor: Jui C. Lin, 55-10, Ben-Jou Rd., Gang-San Jenn, Kaohsiung Hsien, Taiwan

[21] Appl. No.: 440,303

[22] Filed: Nov. 22, 1989

[51] Int. Cl.[5] ..... E05B 09/00

[52] U.S. Cl. ..... 292/337; 292/DIG. 74; 70/461

[58] Field of Search ..... 292/337, DIG. 74, DIG. 60; 70/461, 134

[56] References Cited

U.S. PATENT DOCUMENTS

| | | | |
|---|---|---|---|
| 4,593,542 | 6/1986 | Rotondi | 70/461 |
| 4,602,490 | 7/1986 | Glass | 70/461 |
| 4,662,665 | 5/1987 | Lin | 292/337 |
| 4,768,817 | 9/1988 | Fann | 292/337 |
| 4,772,055 | 9/1988 | Fang | 292/337 |

*Primary Examiner*—Robert L. Wolfe

*Attorney, Agent, or Firm*—Fleit, Jacobson, Cohn, Price, Holman & Stern

[57] ABSTRACT

An auxiliary lock with an extensible device comprising a push button which can function to make a case extend or shrink so that the auxiliary lock can be changed in the short or the long size.

8 Claims, 5 Drawing Sheets

AUXILIARY LOCK WITH AN EXTENSIBLE DEVICE

BACKGROUND OF THE INVENTION

This invention concerns an auxiliary lock with an extensible device. The U.S. Pat. No. 4,662,665 titled "Auxiliary lock with an extensible device" acquired by the same applicant as the invention has a structure, wherein the length of the lock is changed by the pin 642 of the linking plate 64 selectably hooking in one of the two notches 211 or 212 in coordination with the adjustment of the shell 4 and the rotating shell 113. The U.S. Pat. No. 4,664,433 titled "Latch helical backset adjustment", discloses a lock wherein the length of the latch is changed by the bolt guide pin 100 inserting and turning in the flat end portions 128 set in the bolt assembly 36. Besides, the U.S. Pat. No. 4,752,090 titled "Auxiliary lock with an extensible device" acquired by the same applicant as this invention has a structure, wherein the length of a lock is changed by the pin assembly on the dead bolt engaging the helical track formed on the post, and the longitudinal shaft of the post in the connecting plate being rotated.

SUMMARY OF THE INVENTION

The object of this invention is to provide an auxiliary lock with a new different structure, wherein the length of the lock can be changed in a simpler way.

The auxiliary lock in accordance with the present invention comprises a cylinder, a dead bolt, a pair of combining plates, a moving member, a connecting plate, an adjusting plate, a push plate, a case and a push button as the main components.

The cylinder comprises a faceplate to combine with a lid, and an opening in a bottom wall to combine with the pair of combining plates, and contains the dead bolt in its interior so that the dead bolt can extend out of the lid.

The dead bolt is connected with the push plate by means of a pin and holes, able to move straight together with the push plate and to extend out of the lid through an opening in the lid.

The pair of combining plates includes a front and a rear combining plate of similar structure, and hooks at the bottom wall of the cylinder. The front and the rear combining plate are kept parallel at a distance by means of a foot in the rear combining plate received in a hole in the front combining plate. Both combining plates respectively have an opening in which the moving member is received to move to and fro, and two limit notches aligned with each other at an upper edge.

The front combining plate has a guide slot of a horizontal section and two vertical sections plus a round section for the combining post of the knob to pass through, and an outward projection which moves in a horizontal slot in the case, and thus limits the moving distance of the case.

The rear combining plate has a similar guide slot as the front one and a horizontal slot for an end ridge of the push plate to therein move therein to limit the moving distance of the push plate.

The moving member has a cross-shaped through hole for the turning member of the knob to pass through so that the knob can rotate the moving member to push out or pull in the dead bolt. The moving member is connected with the connecting plate with a pin receivable in either of two notches in the two side walls of the case when the moving member is rotated by the knob.

The connecting plate is connected with the moving member at the rear end and with the adjusting plate at the front end separately with a pin.

The adjusting plate is of a reversed U-shaped cross-section and has a slot in an upper side and a shoulder received in either of two notches in the upper edge of the push plate so that the adjusting plate can move the push plate if the adjusting plate is moved by the moving member.

The push plate is connected with the dead bolt and received in a cavity of the adjusting plate, having two notches for a shoulder in the adjusting plate to be selectably firmly received by help of a resilient bar making the adjusting plate to always exert a downward force. And the push plate moves in a straight line as a result of its end ridge moving in the horizontal slot in the rear combining plate.

The case of U-shaped cross-section contains the combining plates and can move longitudinally in relation to the combining plates in changing the short size of the lock into the long size, or reversely. The case is provided with a horizontal slot for the projection in the front combining plate to, and the length of the slot is the distance difference between the short size and the long size of lock.

The push button has a square rod passing through and moving up and down in a vertical slot in the case and a slanting face in contact with the bottom of the adjusting plate. When the button is pushed inward, a adjusting plate can be elevated to rotate with the pin as a pivot, making the shoulder rotate upward, and when the button is released, the button recovers its normal position as a result of being forced by a spring.

BRIEF DESCRIPTION OF THE DRAWINGS

This invention will now be described in detail with reference to accompanying drawings wherein.

DETAILED DESCRIPTION OF THE INVENTION

Figure 1:
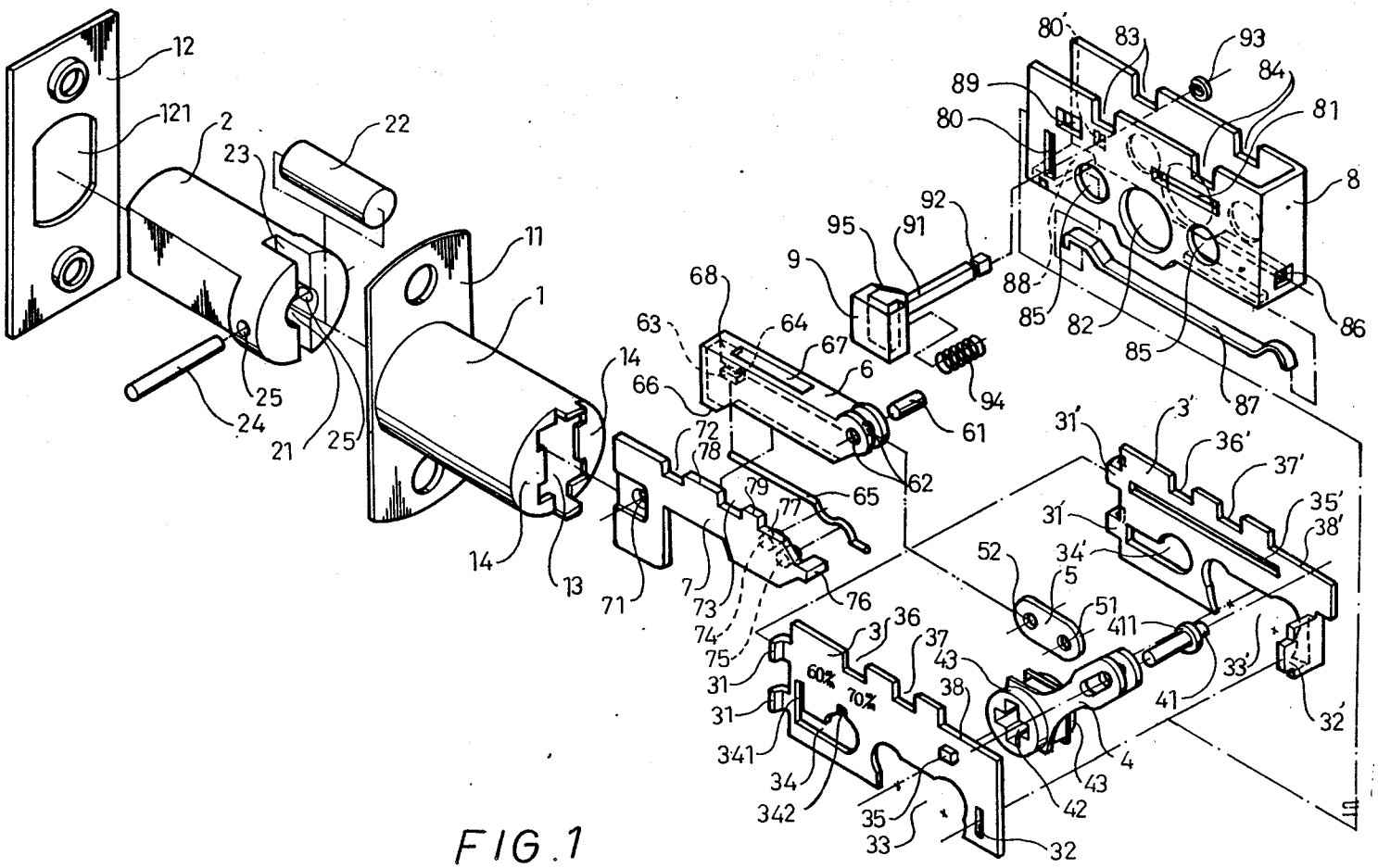
FIG. 1 is an exploded perspective view of the auxiliary lock with an extensible device in accordance with the present invention.

The auxiliary lock with an extensible device in accordance with the present invention shown in FIG. 1 comprises a cylinder 1, a dead bolt 2, a pair of combining plates 3 and 3', a moving member 4, a connecting plate 5, an adjusting plate 6, a push plate 7, a case 8 and a push button 9 as the main components.

The cylinder 1 is provided with a faceplate 11 at an outer end, and contains its dead bolt 2 in the interior, and the faceplate 11 is combined with a lid 12, which is provided with an opening 121 having adjacent surfaces for limiting the length of the dead bolt 2 extending out of the opening 121. The cylinder 1 is also provided with an opening 13 and a wall 14 at an inner end, and the wall 14 is hooked by the combining plates 3 and 3'. The opening 13 receives the adjusting plate 6 and the push plate 7 so as to move the dead bolt 2.

The dead bolt 2 is provided with two flat vertical surfaces symetrically set to slide straight along the both vertial straight edges of the opening 121 in the lid 12. The dead bolt 2 also has at a rear end a vertical slot 23 for receiving one end of the push plate 7 and is connected with said plate 7 by means of a pin 24 inserted in a pin hole 25 and a hole 71 in said plate 7, thereby moving together with said plate 7.

The pair of combining plates consist of the front combining plate 3 and the rear combining plate 3' having similar shape and structure and hooking at the end wall 14 of the cylinder 1 with hooks 31 and 31'. A foot 32' of the rear combining plate 3' is received in a slot 32 in the front combining plate 3 such that both the combining plates are kept together with a certain distance between them. Both combining plates 3 and 3' separately have an opening 33 or 33' for the moving member 4 to move right and left therein. Besides, both combining plates 3 and 3' are separately provided with limit notches 36 and 36', and 37 and 37', which correspondingly align with each other when both combining plates 3 and 3' are combined with the cylinder 1. Both combining plates 3 and 3' assembled together are to be fitted in the case 8, which is provided with notches 83 aligning with the notches 36 and 36' or 37 and 37', and notches 84 aligning with a low shoulder 38 and 38'.

The front combining plate 3 is provided with a guide slot 34 with a horizontal section and two vertical sections 341 and 342 extending upward from both ends of the horizontal section, and the guide slot has a partly round section for a combining post of a knob to pass through. Besides, the front combining plate also has an outward projection 35 receivable in a horizontal slot 81 in the case 8 such that the case 8 is thereby limited in its moving distance.

The rear combining plate 3' is provided with a guide slot 34' with an additional round section corresponding to that of guide slot 34 in the front combining plate 3, and with a horizontal slot 35' for receiving a rear end ridge 76 of the push plate 7. Thus, the moving distance of the push plate 7 is limited by the length of the slot 35'.

The moving member 4 is connected with a pin 41 having a circumferential ridge 411 at a middle section mounted in the moving member 4, with both ends of the pin 41 protruding from the moving member 4 such that the protruding sections of the pin 41 may be received in a notch 83 or 84 in the case 8. The moving member 4 is provided with a cross-shaped through hole 42 for the turning member of the knob to pass through so that the moving member may be rotated with a shaft 43 as a pivot and the shaft 43 is received and rotates in round holes 82 in the case 8.

The connecting plate 5 is shaped as an oval, provided with a hole 51 for the pin 41 to pass through so as to be connected with the moving member 4, and provided with another hole 52 for a pin 61 to pass through so as to be connected with the adjusting plate 6.

The adjusting plate 6 is made up of thin plates secured together, having a reversed U-shaped cross-section, and provided with the hole 62 for a pin 61 to pass through and combine the plate 6 with the connecting plate 5. The adjusting plate 6 is also provided with an inner projection 63 with a hole 64 for receiving an end of a resilient bar 65, and the projection 63 is kept in contact with the side surface of the push plate 7. Besides, the adjusting plate 6 is also provided with a slot 67 at an upper section and a shoulder 68 receivable in a notch 72 or 73 in the push plate 7 such that teeth 78 and 79 may protrude out of the slot 67. Therefore, the push plate 7 cannot be moved by the adjusting plate 6 until said plate 6 has been moved by the moving member 4.

The push plate 7, which is combined and moves together with the dead bolt 2 as a result of the hole 71 pin 24, is located in the interior of the reversed U-shaped adjusting plate 6 and engaged by the projection 63. The push plate 7 is provided with the notches 72 and 73 and a low shoulder 77, 78 and the teeth and 79 separately formed between the notches 72 and 73 and between the notch 73 and the low shoulder 77. The shoulder 68 in the adjusting plate 6 is selectably received in either of the notches 72 and 73. In order to keep the shoulder 68 firmly received therein, two posts 74 and 75 and the rear end rigde 76 are provided on the push plate 7, and the resilient bar 65 is disposed between the post 74 and the post 75, and has one end resting against the end ridge 76 and the other end received in the hole 64 in the projection 63 such that the adjusting plate 6 always is urged downward with the pin 61 as a flucrum, firmly urging the shoulder 68 into either of the notches 72 and 73. The end ridge 76 is received in the horizontal slot 35' in the rear combining plate 3', making the push plate 7 move back and forth in a straight line.

The case 8 is made of a bent plate, having a U-shaped cross-section for containing the combining plates 3 and 3' in its interior, and is provided with the horizontal slot 81 for receiving the projection 35 on the front combining plate 3 such that the case 8 only moves in a straight line in relation to said plates 3 and 3'. The case 8 is also provided with the two round holes 82 in both side parallel walls for the shaft 43 to fit and turn therein, a round hole 85 separately on both the lateral sides of the hole 82 for the connecting post of the knob to pass through, the notches 83 and 84 in one of which the pin 41 is selectively received when the moving member 4 is rotated, a square hole 86 for receiving one end of a resilient member 87, a post 88 for receiving the other end of the resilient member 87 such that said member 87 urgingly contacts the bottom of the moving member 4 and thereby the moving member 4 cannot rotate of itself if it is not moved by the knob. Besides, the case 8 is provided with a window 89, through which the size mark on the front combining plate 3 can be seen when the case 8 moves forward in relation to said plate 3 and 3', and thus the size of the lock can be known. In addition, the case 8 is provided with the slot 80 and a hole 80' for a push button 9 to pass through.

The push button 9 is provided with a square rod 91 having a circumferential groove 92, and the square rod 91 can pass through the slot 80 and the hole 80' in the case 8, extend out of the hole 80' and have its groove 92 detained by a C-shaped ring 93. There is a coiled spring 94 set between the button 9 and the wall of the case 8 for always urging the button 9 outward. Besides, the button 9 is also provided with a slanting face 95 inclined to the rod 91 and for containing with the bottom 66 of the adjusting plate 6 such that the slanting face 95 may gradually elevate said plate 6, which can then rotate upward with the pin 61 as a pivot, raising up the shoulder 68 when the button 9 is pressed inward. On the contrary, when the button 9 is released, it recovers its original position as a result of being biased by the spring 94, and then the shoulder 68 again is received in either of the notches 72 and 73, as the slanting face 95 leaves the bottom 66 of the adjusting plate 6, which is biased by the resilient bar 65.

Figure 2:
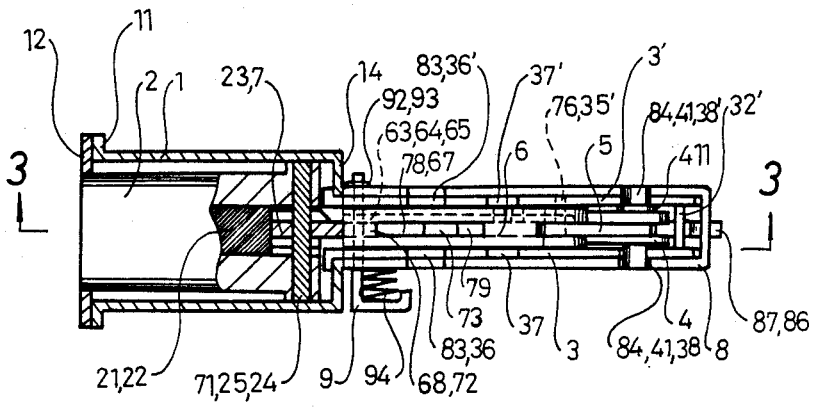
FIG. 2 is a cross-sectional view taken along line 2—2 of FIG. 3.
Figure 3:
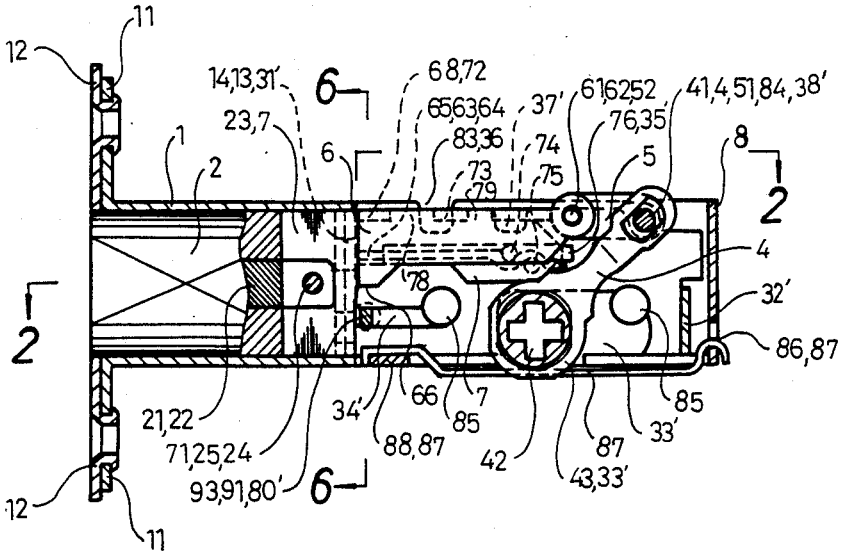
FIG. 3 is a cross-sectional view taken along line 3—3 of FIG. 2.

Now, referring to FIGS. 2 and 3 showing this lock adjusted in the short size, the dead bolt 2 is retracted in the cylinder 1, connected with the push plate 7 by the pin 24, and the shoulder 68 in the adjusting plate 6 is received in the notch 72 in the push plate 7, the cross-shaped through holes 42 are located at the left side of the openings 33 and 33', and the round holes 85 are separately located at the upper right corners of the round sections of the guide slots 34 and 34' and the openings 33 and 33'. Therefore, the lock can be combined with the knob and the combining post of the knob can pass through the holes 85, and the pin 41 is receiving in the notches 84 in the case 8.

Figure 4:
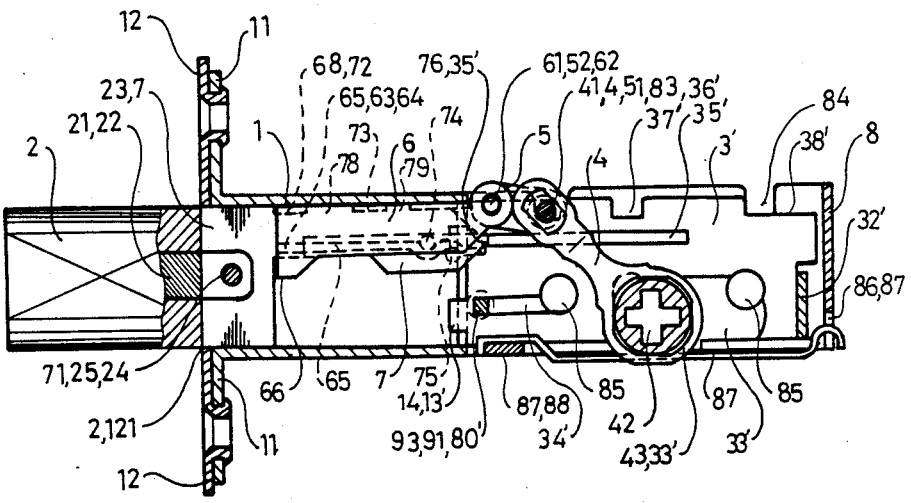
FIG. 4 is a cross-sectional view of the auxiliary lock adjusted in the short size with its dead bolt extending out of the faceplate.

Next, referring to FIG. 4, when the moving member 4 is rotated anti-clockwise by the knob, the pin 41 moves from the notches 84 to the notches 83, and therefore the adjusting plate 6 is moved by the connecting plate 5, which is pushed to the left by the moving member 4, and the adjusting plate 6 pushes both the push plate 7 and the dead bolt 2 to the left so that the dead bolt 2 is pushed outside the lid 12.

Figure 5:
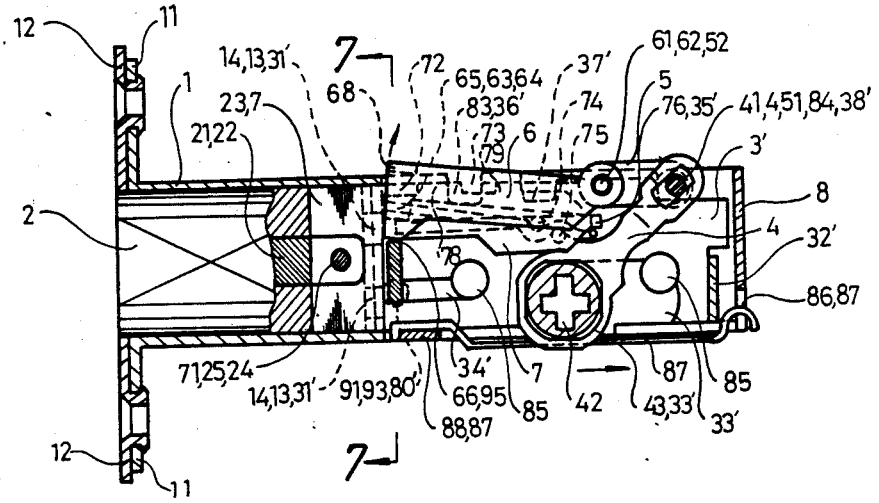
FIG. 5 is a cross-sectional view of changing this auxiliary lock from the short size to the long size.
Figure 7:
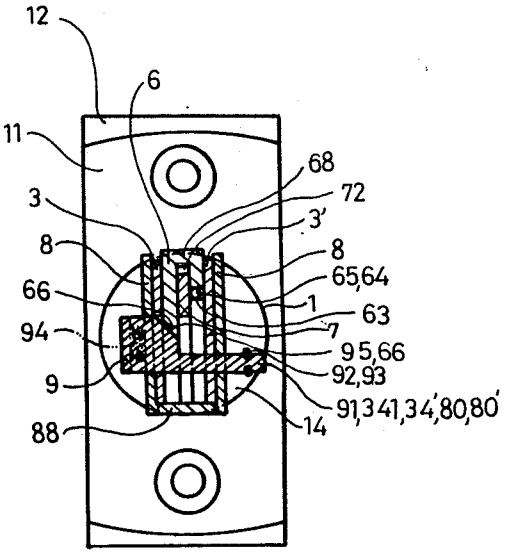
FIG. 7 is a cross-sectional view taken along line 7—7 of FIG. 5.
Figure 6:
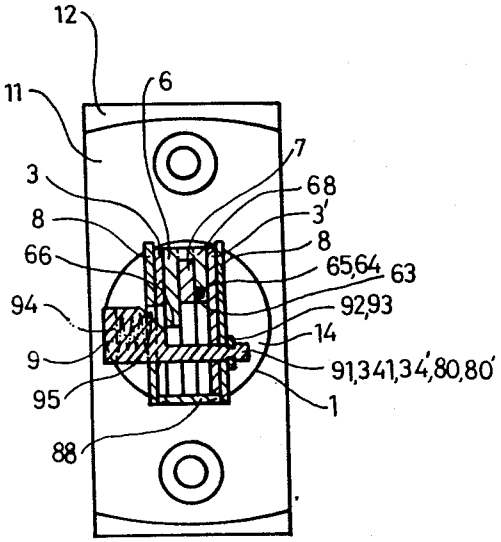
FIG. 6 is a cross-sectional view taken along line 6—6 of FIG. 3.
Figure 8:
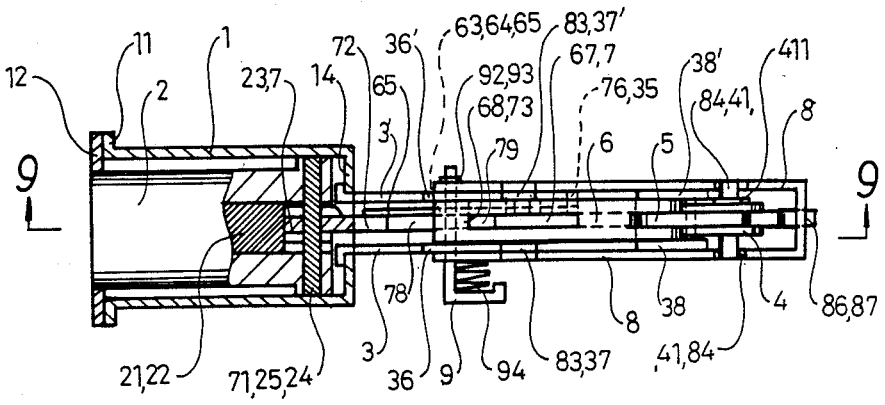
FIG. 8 is a cross-sectional view taken along line 8—8 of FIG. 9.
Figure 9:
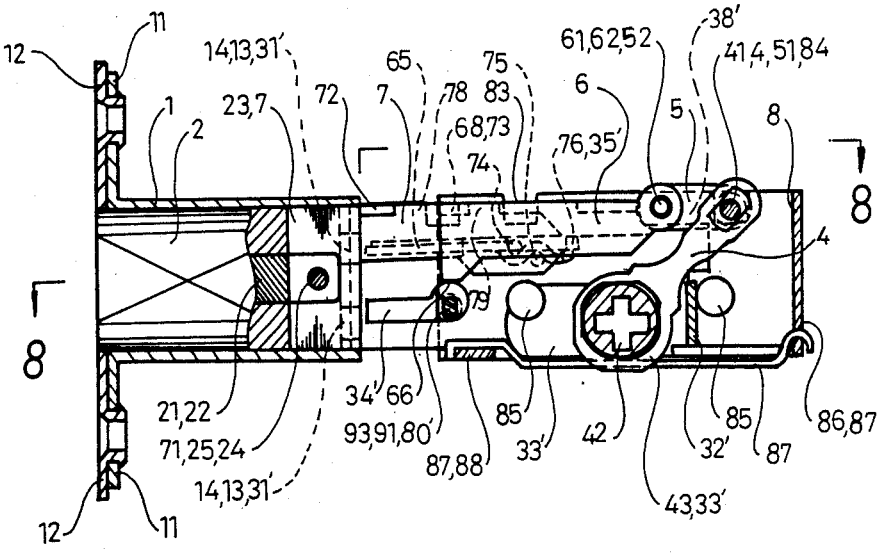
FIG. 9 is a cross-sectional view taken along line 9—9 of FIG. 8, wherein the auxiliary lock is adjusted in the long size.

Referring to FIG. 5, if the lock in the short size is to be changed to the long size, the dead bolt 2 should be inside the cylinder 1. Then the button 9 is pressed inward, as shown in FIGS. 6 and 7, making the slanting face 95 raise up the bottom 66 of the adjusting plate 6, which then rotates with the pin 61 as a pivot, elevating the shoulder 68 out of the notch 72 as shown in FIG. 5. Then the case 8, now capable of being pulled to the right, is moved to the right, changing the lock from the short size to the long size as shown in FIGS. 8 and 9, being guided for horizontal straight-line movement by means of the slot 81 and the projection 35 of the front combining plate 3. After the button 9 is released, the button 9 recovers its original position, and the adjusting plate 6 is forced down by the resilient bar 65, with the shoulder 68 being received in the notch 73. Then the cross-shaped hole 42 in the moving member 4 is located at the right side of the openings 33 and 33', the round holes 85 separately located correspondingly at the upper left corners of the openings 33 and 33' and at the outside of the outer end of the combining plates 3 and 3'. Therefore, the lock is still combined with the knob, and the dead bolt 2 can extend out of the lid 12 or retract into the cylinder 1.

In summary, the auxiliary lock can be changed to have two kinds of size, adjustable in a very simple way, wherein pressing the button 9 and horizontal moving of the case 8 can attain the purpose of changing the lock from the short size to the long size or reversely.

What is claimed is:

1. An auxiliary lock with an extensible device comprising:

a cylinder having a dead bolt reciprocable therein and having a faceplate at an outer end combinable with a lid which is provided with an opening through which the dead bolt can be extended from the cylinder a preselected length, the cylinder also having an opening in a wall at an inner end in which adjacent ends of a pair of combining plates are fixedly mounted;

said dead bolt having an inner end connected with a push plate;

said pair of combining plates being disposed in a case movable between advanced and retracted positions, elongated slots in the combining plates for receiving a rotatable shaft of a pivoted moving member mounted in holes in said case, so that the shaft can move in said slots as said case is moved between its advanced and retracted positions;

said shaft of said moving member being provided with a through hole for receiving a turning member of a knob;

means for pivotably connecting the moving member to an adjusting member;

said adjusting member being resiliently biased toward said push plate and having a shoulder portion selectively receivable in one of two spaced notches in said push plate depending upon whether the case is in its advanced or retracted position;

a resiliently biased push button mounted for reciprocable movement in the case, said push button including a slanting face for contacting the adjusting member and causing the adjusting member to move so that the shoulder portion thereof disengages from the one of the two notches in the push plate in which it is then received, said adjusting member then being movable together with the case to move the shoulder portion to the other notch in the push plate, with said shoulder portion then being received in the other notch as the resiliently biased adjusting member returns to an original position, the lock thereby being changed in its size from a short length to a long length or reversely.

2. The auxiliary lock as claimed in claim 1, wherein the adjusting member has a reversed U-shaped cross-section defining a cavity in which the push plate is received, and is provided with an upper slot, and wherein said push plate has teeth defining the notches in the push plate which are receivable in said upper slot.

3. The auxiliary lock as claimed in claim 1, wherein the push plate has a laterally projecting end portion and laterally projecting posts near the end portion for receiving one end of a resilient biasing member, the other end of said resilient biasing member being received in a hole in a projection on the adjusting member such that the resilient member biases the adjusting member to cause the shoulder portion on the adjusting member to be received in the notches in the push plate.

4. The auxiliary lock as claimed in claim 1, wherein the push button is provided with a square shaft which passes through slots in the case, said square shaft being retained in position in the case by a c-shaped ring on one end of said shaft and engageable with a wall of said case.

5. The auxiliary lock as claimed in claim 1, wherein the notches in the push plate, and a low shoulder of the push plate for receiving a pivot pin of the moving member during a dead bolt retracting operation, can be aligned correspondingly with notches and low shoulders on the combining plates when the dead bolt is retracted in the cylinder, the notches in the combining plates being for receiving said pivot pin in dead bolt-extending operations in the short and long lock length, respectively, and the low shoulders of the combining plates receiving said pivot pin in the dead bolt-retracting operation.

6. The auxiliary lock as claimed in claim 1, wherein the movement of the case in relation to the combining plates is the same distance as the distance between the two notches in the push plate.

7. The auxiliary lock claimed in claim 1, wherein:

the combining plates are connected to the inner end of the cylinder by hooks;

the combining plates, push plate and case include cooperable projection-and-slot means for limiting movement of the push plate and the case to respective preselected amounts of straight-line movement;

the push button has a square shaft extending through the case;

the combining plates include elongated guide slots in which the push button square shaft moves during movement of the case between its advanced and retracted positions, with at least one guide slot including vertical slot sections extending upward from opposite ends of the guide slot, and each guide slot having a rounded portion at one end for receiving a knob connecting post; and the case includes additional holes on opposite sides of the round holes in the case for receiving the rotatable shaft of the moving member, said additional holes in the case being for receiving knob connecting posts.

8. An auxiliary lock with an extensible device which can be changed from a long length to a short length and reversely, comprising:

a cylinder having a dead bolt reciprocable therein and having a face plate at an outer end combinable with a lid which is provided with an opening through which the dead bolt can be extended from the cylinder;

a reciprocable push plate connected at an inner end of said dead bolt;

a case selectively movable between advanced and retracted positions;

a pair of fixed combining plates having adjacent forward ends secured in an opening in an inner end of said cylinder;

an adjusting member including a shoulder portion selectively receivable in one of a pair of spaced notches in said push plate depending on whether said case is in the advanced or retracted position;

means for retaining said shoulder portion of said adjusting member in a selected one of said notches in said push plate;

a pivoted moving member pivotably connected to said adjusting member and provided with a rotatable shaft having a through hole for receiving a turning member of a knob, said shaft being rotatably mounted in said case and being movable between opposite ends of horizonal slots in the combining plates when said case is moved into its advanced and retracted positions relative to said combining plates; and a push button mounted for reciprocable movement on said case, said push button including a camming surface engageable with said adjusting member to move said shoulder portion on said adjusting member out of the notch in said push plate in which it is received, to permit movement of said case, adjusting member and moving member relative to said combining plates and said push plate so that the shoulder portion on said adjusting member reseats in the other of said notches in said push plate.

* * * * *